US011713765B2

(12) United States Patent
Mori et al.

(10) Patent No.: US 11,713,765 B2
(45) Date of Patent: Aug. 1, 2023

(54) MAGNETIC PUMP AND ROTARY BODY FOR THE MAGNETIC PUMP

(71) Applicant: World Chemical Co., Ltd., Toyko (JP)

(72) Inventors: Wataru Mori, Tokyo (JP); Toru Ebihara, Tokyo (JP); Takashi Yoshida, Tokyo (JP)

(73) Assignee: World Chemical Co., Ltd., Tokyo (JP)

( * ) Notice: Subject to any disclaimer, the term of this patent is extended or adjusted under 35 U.S.C. 154(b) by 376 days.

(21) Appl. No.: 17/140,196

(22) Filed: Jan. 4, 2021

(65) Prior Publication Data

US 2022/0018349 A1 Jan. 20, 2022

(30) Foreign Application Priority Data

Jul. 20, 2020 (JP) ..... 2020-123621

(51) Int. Cl.
*F04D 13/02* (2006.01)
*F04D 29/046* (2006.01)
*F04D 29/20* (2006.01)

(52) U.S. Cl.
CPC ..... *F04D 13/024* (2013.01); *F04D 13/026* (2013.01); *F04D 29/046* (2013.01); *F04D 29/20* (2013.01)

(58) Field of Classification Search
CPC .... F04D 13/024; F04D 13/026; F04D 29/046; F04D 29/20
See application file for complete search history.

(56) References Cited

U.S. PATENT DOCUMENTS 7,101,158 B2 * 9/2006 Hembree ..... F04D 13/027 417/420
7,500,829 B2 * 3/2009 Edwards ..... F04D 13/027 416/241 A (Continued)

FOREIGN PATENT DOCUMENTS

JP 3403719 B2 5/2003
JP 4104542 B2 6/2008

(Continued)

*Primary Examiner* — Nathan C Zollinger
(74) *Attorney, Agent, or Firm* — Brian B. Shaw, Esq.; Harter Secrest & Emery LLP

(57) ABSTRACT

A magnetic pump is provided that includes a magnet can and an impeller that are individually formed, that is capable of easily performing assembling/disassembling, that has high workability during manufacturing or maintenance, and that has high strength in a connection part between the magnet can and the impeller, and to provide a rotary body for the magnetic pump. Particularly, the fitted connection part between the magnet can and the impeller is a spigot ferrule that has a simple structure and that is firmly connectable, and a cutout portion and a convex portion are formed at a part at which an innermost part of a socket and a front end part of a spigot face each other, and the connection strength can be further heightened by twisting and turning the spigot-ferrule part, and the return of a turned state of the spigot-ferrule part is prevented by fitting the restraining member into a gap generated behind the convex portion in the turning direction of the convex portion that has entered the cutout portion and the cutout portion, and therefore the fitted connection part is never loosened.

6 Claims, 5 Drawing Sheets

(56) References Cited

U.S. PATENT DOCUMENTS

| | | | | |
|---|---|---|---|---|
| 10,302,092 | B2 * | 5/2019 | Song | F04D 13/064 |
| 11,028,851 | B2 * | 6/2021 | Diekmann | F04D 25/0606 |
| 2009/0062020 | A1 * | 3/2009 | Edwards | F04D 13/027<br>415/122.1 |

FOREIGN PATENT DOCUMENTS

| | | | |
|---|---|---|---|
| JP | 5993274 | B2 | 9/2016 |
| JP | 6324999 | B2 | 5/2018 |

* cited by examiner

MAGNETIC PUMP AND ROTARY BODY FOR THE MAGNETIC PUMP

TECHNICAL FIELD

The present invention relates to a magnetic pump and a rotary body for the magnetic pump, and, more particularly, the present invention relates to a magnetic pump configured to attach an impeller to a magnet can that houses a driven-side magnet, and relates to a rotary body for the magnetic pump.

BACKGROUND ART

The magnetic pump is composed chiefly of a magnet can that is rotatably supported by a shaft fixed in a casing (also called a support shaft or a rotational shaft) through a rotational bearing and that houses a driven-side magnet, an impeller that suctions and discharges a liquid by being attached to one end of the magnet can and being rotated, a driving-side magnet that rotates near an outer periphery of the casing outside the casing, and a motor that rotationally drives the driving-side magnet, and the magnetic pump is configured to perform a pump operation by allowing a rotational force of the driving-side magnet to be transmitted to the driven-side magnet in a noncontact state by means of a magnetic force. This configuration makes it possible to perform a pump operation without liquid leakage because the motor and a pump part are blocked from each other.

The configuration of both the magnet can and the impeller is broadly classified into (1) a configuration in which a magnet can and an impeller that are individually formed are connected and fixed to each other (for example, Patent Literatures 1 to 3, etc.), and (2) a configuration in which a magnet can and an impeller are formed integrally with each other (for example, Patent Literature 4, etc.).

PRIOR ART DOCUMENTS

Japanese Patent No. 3403719
Japanese Patent No. 4104542
Japanese Patent No. 6324999
Japanese Patent No. 5993274

SUMMARY OF THE INVENTION

Problems to be Solved by the Invention

The configuration of both the magnet can and the impeller is broadly classified into (1) a configuration in which a magnet can and an impeller that are individually formed are connected and fixed to each other (for example, Patent Literatures 1 to 3, etc.), and (2) a configuration in which a magnet can and an impeller are formed integrally with each other (for example, Patent Literature 4, etc.).

Techniques of Patent Literatures 1 to 3 are each configured to fix a magnet can and an impeller together by allowing the magnet can and the impeller to be fitted to each other in a rotational-shaft direction and by allowing a fixing pin to pass through a fitted part in an orthogonal direction.

The configuration of both the magnet can and the impeller is broadly classified into (1) a configuration in which a magnet can and an impeller that are individually formed are connected and fixed to each other (for example, Patent Literatures 1 to 3, etc.), and (2) a configuration in which a magnet can and an impeller are formed integrally with each other (for example, Patent Literature 4, etc.).

If the magnet can and the impeller are individually formed as in the techniques of Patent Literatures 1 to 3, a load is imposed onto a connection part between the magnet can and the impeller, for example, when the pump is rotated at a high speed or is reversely rotated, and there has been a concern that looseness or clattering will occur in a fitted connection part because of, for example, the breakage of a fixing pin. If a connection structure is reinforced, for example, by increasing the number of pins in order to cope with the aforementioned problem, it has been understood that problems will occur, e.g., much time or labor hours will be consumed in assembling or disassembling, and workability will be lowered during manufacturing or maintenance.

On the other hand, if the magnet can and the impeller are formed integrally with each other as in the technique of Patent Literature 4, and if trouble, such as damage, occurs in either one of the magnet can and the impeller, both the magnet can and the impeller that are formed integrally with each other are required to be each replaced with another, and it is impossible to replace only one of them, which has caused any trouble, with another, and therefore costs are raised.

Therefore, it is an object of the present invention to provide a magnetic pump that includes a magnet can and an impeller that are individually formed, that is capable of easily performing assembling/disassembling, that has high workability during manufacturing or maintenance, and that has high strength in a connection part between the magnet can and the impeller, and to provide a rotary body for the magnetic pump.

Means for Solving the Problems

The aforementioned object of the present invention is achieved by the following configurations.

A magnetic pump that is a magnet-coupling type pump that generates a liquid transportation force by rotating an impeller disposed at a driven-side magnet by rotating a driving-side magnet, the magnetic pump configured so that the driven-side magnet is housed in a magnet can, and the magnet can is attached to a shaft fixed in a pump casing through a rotational bearing, and the impeller is attached and fixed to an end side in a rotational-shaft direction of the magnet can, wherein the impeller and the magnet can are attached and fixed together such that a socket formed at either one of a part of the impeller and a part of the magnet can that face each other and a spigot formed at a remaining one of the part of the impeller and the part of the magnet can are fitted together in the rotational-shaft direction in a spigot-ferrule manner, and are twisted and turned with respect to the rotational shaft, and are then inhibited from reaching a loosened state while restraining return of a turned state, and, as a result, a connection between the impeller and the magnet can is fixed, and wherein the return of the turned state is restrained such that a cutout portion is formed at either one of an innermost part of the socket and a front end part of the spigot that face each other, and a convex portion is formed at a remaining one of the innermost part of the socket and the front end part of the spigot, and the convex portion is allowed to enter the cutout portion and is turned, and then a restraining member with which a gap generated behind the convex portion in a turning direction of the convex portion is filled is fitted into the gap between the cutout portion and the convex portion.

In such magnetic pump, the restraining member is disposed at a front end part of a rotational bearing that is inserted from an opposite end side in the rotational-shaft direction of the magnet can after the impeller and the magnet can are attached and fixed together.

The magnetic pump can be further configured wherein a convex strip that is extended obliquely with respect to the rotational-shaft direction is disposed at either one of an inner wall portion of the socket and an outer wall portion of the spigot that are each a spigot-ferrule part, and an concave strip that is entered by the convex strip is disposed at a remaining one of the inner wall portion and the outer wall portion so as to be extended obliquely with respect to the rotational-shaft direction in the same way as the convex strip, and, when the impeller is attached to the magnet can, fitting and twisting/turning in the rotational-shaft direction are guided by allowing the convex strip to enter the concave strip when the socket and the spigot are connected together in the spigot-ferrule manner.

The magnetic pump can be further configured, wherein the convex strip and the concave strip are formed so that a direction of twisting/turning caused by both the convex strip and the concave strip disposed at the spigot-ferrule part becomes opposite to a rotation direction of both the magnet can and the impeller.

The magnetic pump can be further configured, wherein a width in a rotation direction of both the convex strip and the concave strip disposed at the spigot-ferrule part is wide on an entrance side from which the convex strip enters the concave strip, and the width is narrow on an innermost side.

A further configuration includes a rotary body for a magnetic pump, the rotary body being used for a magnet-coupling type pump that generates a liquid transportation force by rotating an impeller disposed at a driven-side magnet by rotating a driving-side magnet, the rotary body configured to include a magnet can that houses the driven-side magnet and an impeller that is attached and fixed to an end side in a rotational-shaft direction of the magnet can, wherein the impeller and the magnet can are attached and fixed together such that a socket formed at either one of a part of the impeller and a part of the magnet can that face each other and a spigot formed at a remaining one of the part of the impeller and the part of the magnet can are fitted together in the rotational-shaft direction in a spigot-ferrule manner, and are twisted and turned with respect to the rotational shaft, and are then inhibited from reaching a loosened state while restraining return of a turned state, and, as a result, a connection between the impeller and the magnet can is fixed, and wherein the return of the turned state is restrained such that a cutout portion is formed at either one of an innermost part of the socket and a front end part of the spigot that face each other, and a convex portion is formed at a remaining one of the innermost part of the socket and the front end part of the spigot, and the convex portion is allowed to enter the cutout portion and is turned, and then a restraining member with which a gap generated behind the convex portion in a turning direction of the convex portion is filled is fitted into the gap between the cutout portion and the convex portion.

The rotary body for a magnetic pump can be further configured, wherein the rotary body includes, in addition to the impeller and the magnet can, a rotational bearing that is inserted from an opposite end side in the rotational-shaft direction of the magnet can after the impeller and the magnet can are attached and fixed together and that serves as a bearing of a shaft fixed in a pump casing, and the restraining member is disposed at a front end part of the rotational bearing that is inserted in the magnet can.

The rotary body for a magnetic pump can be further configured, wherein a convex strip that is extended obliquely with respect to the rotational-shaft direction is disposed at either one of an inner wall portion of the socket and an outer wall portion of the spigot that are each a spigot-ferrule part, and an concave strip that is entered by the convex strip is disposed at a remaining one of the inner wall portion and the outer wall portion so as to be extended obliquely with respect to the rotational-shaft direction in the same way as the convex strip, and, when the impeller is attached to the magnet can, fitting and twisting/turning in the rotational-shaft direction are guided by allowing the convex strip to enter the concave strip when the socket and the spigot are connected together in the spigot-ferrule manner.

The rotary body for a magnetic pump can be further configured, wherein the convex strip and the concave strip are formed so that a direction of twisting/turning caused by both the convex strip and the concave strip disposed at the spigot-ferrule part becomes opposite to a rotation direction of both the magnet can and the impeller.

The rotary body for a magnetic pump can be further configured, wherein a width in a rotation direction of both the convex strip and the concave strip disposed at the spigot-ferrule part is wide on an entrance side from which the convex strip enters the concave strip, and the width is narrow on an innermost side.

Effects of the Invention

According to the present invention, it is possible to provide a magnetic pump that includes a magnet can and an impeller that are individually formed, that is capable of easily performing assembling/disassembling, that has high workability during manufacturing or maintenance, and that has high strength in a connection part between the magnet can and the impeller, and to provide a rotary body for the magnetic pump.

Particularly, the fitted connection part between the magnet can and the impeller is a spigot ferrule that has a simple structure and that is firmly connectable, and a cutout portion and a convex portion are formed at a part at which an innermost part of a socket and a front end part of a spigot face each other, and the connection strength can be further heightened by twisting and turning the spigot-ferrule part, and the return of a turned state of the spigot-ferrule part is prevented by fitting the restraining member into a gap generated behind the convex portion in the turning direction of the convex portion that has entered the cutout portion and the cutout portion, and therefore the fitted connection part is never loosened.

Therefore, even if a load is imposed onto the connection part between the magnet can and the impeller, for example, when the pump is rotated at a high speed or is reversely rotated, there is no concern that looseness or clattering will occur in the fitted connection part, and, moreover, much time or labor hours are not consumed in assembling or disassembling, and workability is excellent during manufacturing or maintenance because the fitted connection part of the spigot-ferrule configuration is configured to be simple. Additionally, if trouble, such as damage, occurs in either one of the magnet can and the impeller, it is possible to replace only one of them, which has caused any trouble, with another as necessary.

According to a configuration of the invention, the rotational bearing, which is one of the essential constituents of the magnetic pump, is configured to be provided with the restraining member, and therefore it is unnecessary to add extra constituents in order to connect the magnet can and the impeller together, and it is possible to fix the fitting/connection between the magnet can and the impeller by means of a simple mechanism that uses only essential constituents.

According to a configuration of the invention, when the magnet can and the impeller are connected together, it is possible to simultaneously perform the fitting in the rotational-shaft direction and the twisting/turning with respect to the rotational shaft.

According to the invention shown in claim 4 or claim 9, a tightening force acts in directions in which the convex strip and the concave strip are pulled by each other when the impeller makes positive rotation, and therefore the convex strip and the concave strip that come into contact with each other obliquely in the rotation direction are connected together more firmly.

According to a configuration of the invention, an embodiment in which the convex strip is allowed to enter the concave strip that functions as a guide when these are fitted and connected together is formed so that the entrance side of the concave strip is wide and so that the front end part, which first enters the concave strip, of the convex strip is narrow, and therefore it is easy to allow the convex strip to enter the concave strip.

DETAILED DESCRIPTION OF THE PREFERRED EMBODIMENTS

The present invention will be hereinafter described on the basis of an embodiment.

A magnetic pump of the present invention is a magnet-coupling type pump that rotates an impeller disposed at a driven-side magnet by rotating a driving-side magnet and that generates a liquid transportation force, and is a technique relative to a configuration applied to the magnetic pump configured so that the driven-side magnet is housed in the magnet can, so that the magnet can is attached to a shaft fixed in a pump casing through a rotational bearing, and so that the impeller is attached and fixed to an end side in a rotational-shaft direction of the magnet can, i.e., is a technique relative to a configuration in which the magnet can and the impeller that are individually formed are connected and fixed together, which is a technique relative to Configuration (1) of [Background Art] mentioned above.

The magnetic pump is a publicly known technique, and therefore a drawing depicting the entire magnetic pump including a pump casing, a drive motor, a driving-side magnet, etc., is omitted, and, in the present description, a magnet can, an impeller, and a rotational bearing that are chief components of the present invention are depicted, i.e., a rotary body for the magnetic pump is depicted, and this configuration will be hereinafter described.

The driven-side magnet housed in the magnet can, a bearing disposed at the rotational bearing, etc., are constituents included in a well-known configuration in the magnetic pump, and therefore the depiction of these constituents is also omitted.

Figure 6:
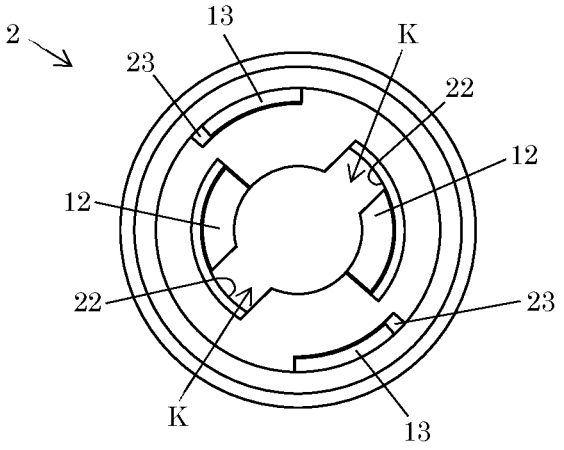
FIG. 6 is a plan view showing a state after the convex strip of the impeller of the connection configuration of FIGS. 1 and 2 has entered the concave strip of the magnet can.
Figure 7:
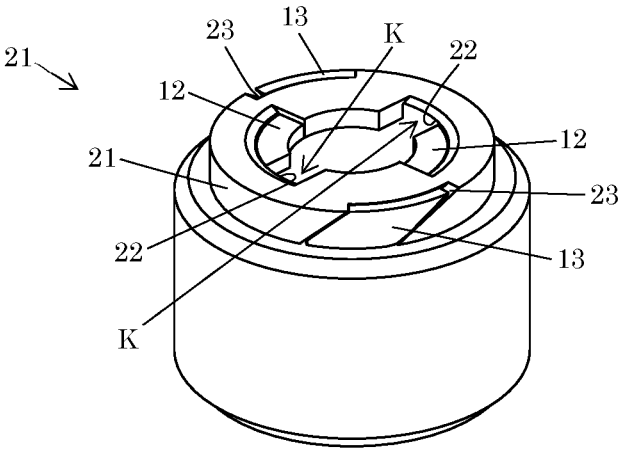
FIG. 7 is a perspective view showing a state after the convex strip of the impeller of the connection configuration of FIGS. 1 and 2 has entered the concave strip of the magnet can.
Figure 9:
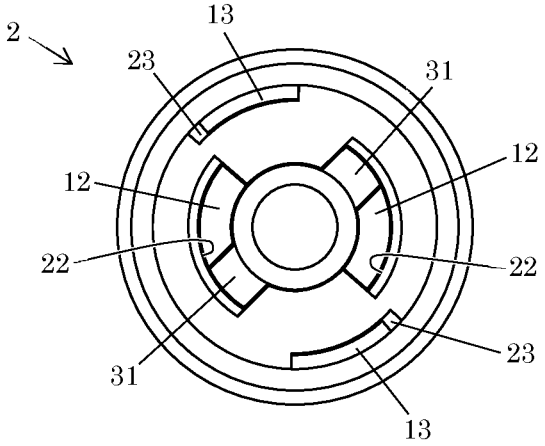
FIG. 9 is a plan view showing a state in which the rotational bearing has been inserted in the magnet can after the convex strip of the impeller of the connection configuration of FIGS. 1 and 2 has entered the concave strip of the magnet can.
Figure 10:
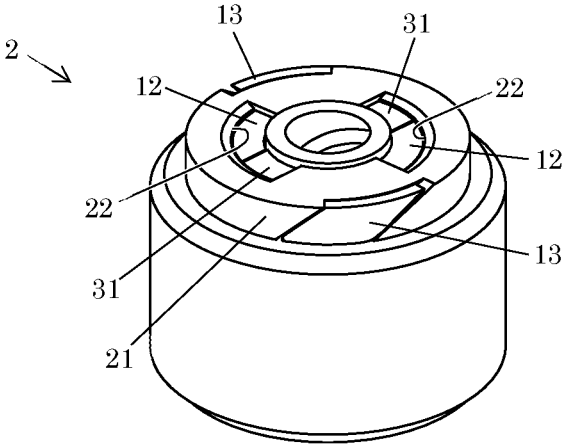
FIG. 10 is a perspective view showing a state in which the rotational bearing has been inserted in the magnet can after the convex strip of the impeller of the connection configuration of FIGS. 1 and 2 has entered the concave strip of the magnet can.
Figure 11:
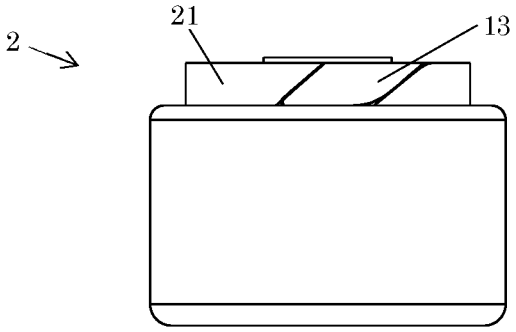
FIG. 11 is a side view showing a state in which the rotational bearing has been inserted in the magnet can after the convex strip of the impeller of the connection configuration of FIGS. 1 and 2 has entered the concave strip of the magnet can.

In a configuration in which the magnet can and the impeller that are individually formed are connected together, the present invention is chiefly configured so that, as shown in the accompanying drawings, the impeller 1 and the magnet can 2 are attached and fixed together such that a socket 11 formed at either one (in the present embodiment, the impeller 1) of a part of the impeller 1 and a part of the magnet can 2 that face each other and a spigot 21 formed at a remaining one (in the present embodiment, the magnet can 2) of the part of the impeller 1 and the part of the magnet can 2 are fitted together in the rotational-shaft direction in a spigot-ferrule manner, and are twisted and turned with respect to the rotational shaft, and are then inhibited from reaching a loosened state while restraining return of a turned state, and, as a result, a connection between the impeller 1 and the magnet can 2 is fixed, and the return of the turned state is restrained such that a cutout portion 22 is formed at either one (in the present embodiment, spigot 21) of an innermost part of the socket 11 and a front end part of the spigot 21 that face each other, and a convex portion 12 is formed at a remaining one (in the present embodiment, socket 11) of the innermost part of the socket 11 and the front end part of the spigot 21, and the convex portion 12 is allowed to enter the cutout portion 22 and is turned, and then a restraining member 31 with which a gap K generated behind the convex portion 12 in a turning direction of the convex portion 12 (which is represented by reference sign K in the plan view of FIG. 6 and the perspective view of FIG. 7) is filled is fitted into the gap K between the cutout portion 22 and the convex portion 12 as shown in the plan view of FIG. 9 and the perspective view of FIG. 10.

Figure 1:
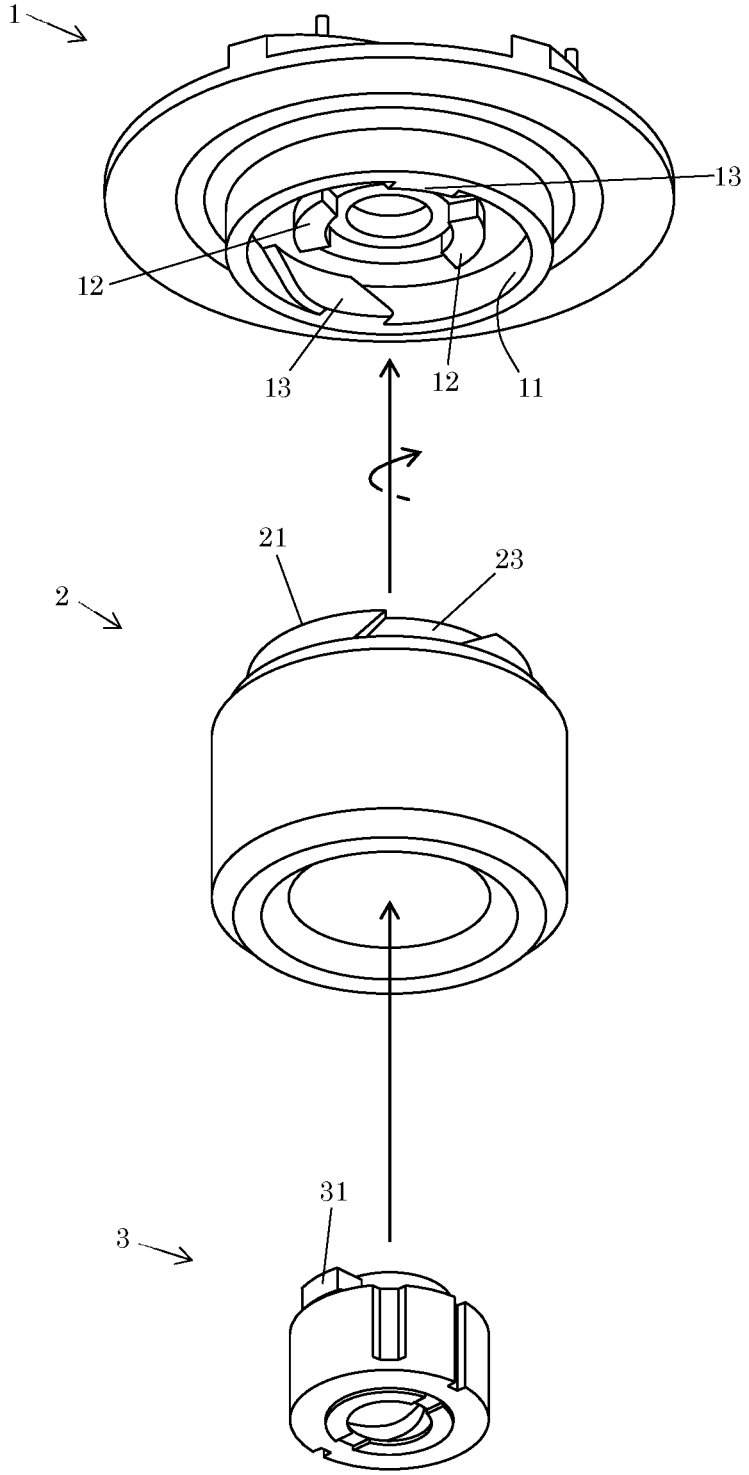
FIG. 1 is a perspective view showing an example of a connection configuration of a magnet can, an impeller, and a rotational bearing of a rotary body for a magnetic pump according to the present invention.
Figure 2:
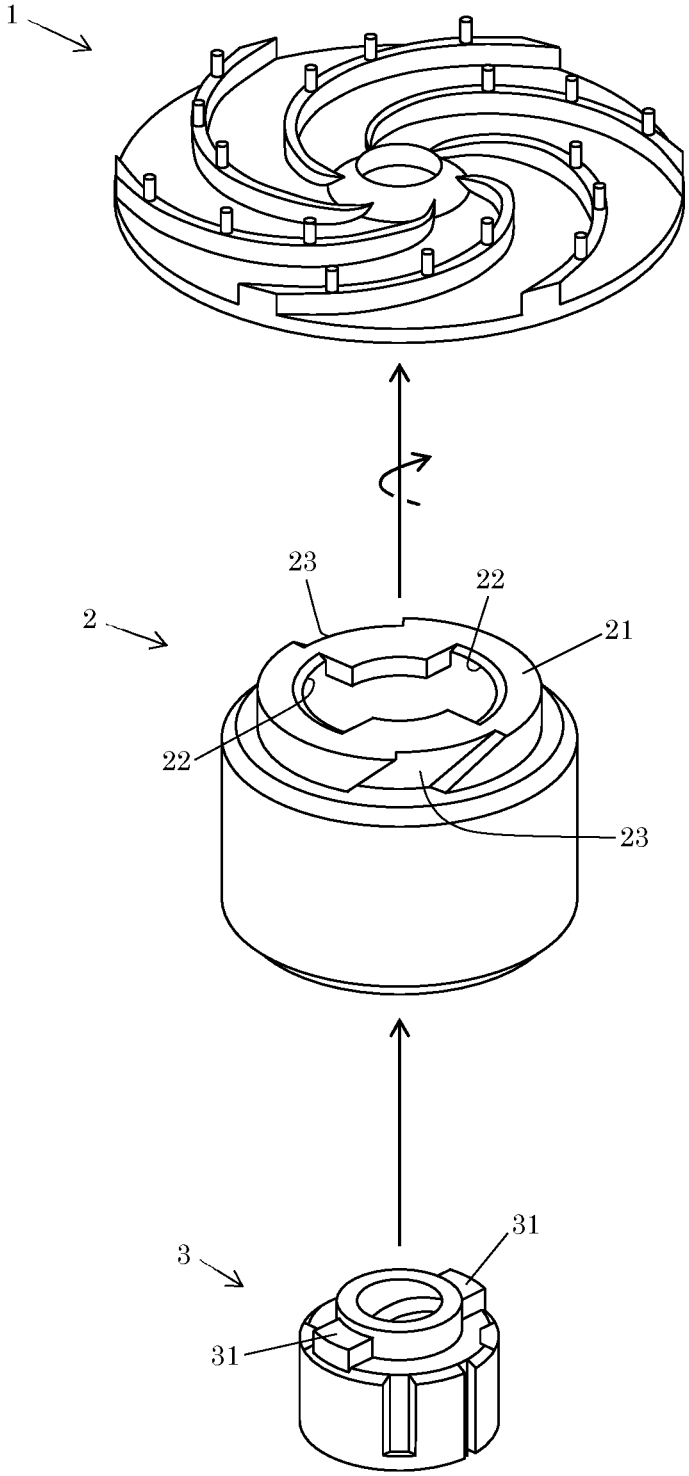
FIG. 2 is a perspective view of the connection configuration of FIG. 1 seen from another direction.
Figure 3:
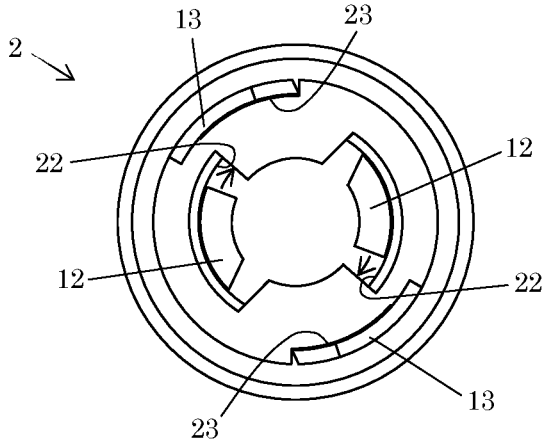
FIG. 3 is a plan view showing a state immediately before a convex strip of the impeller of the connection configuration of FIGS. 1 and 2 enters a concave strip of the magnet can.
Figure 4:
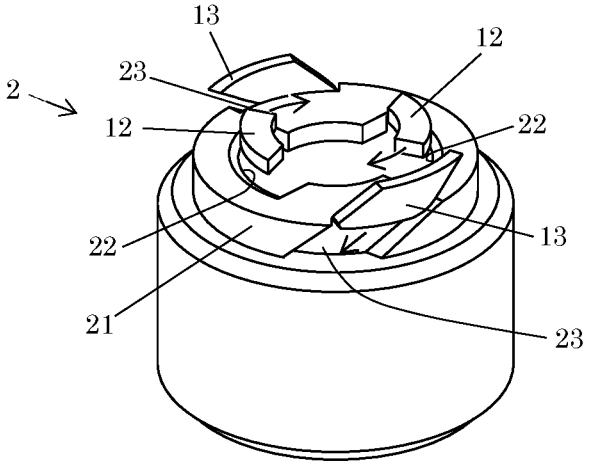
FIG. 4 is a perspective view showing a state immediately before the convex strip of the impeller of the connection configuration of FIGS. 1 and 2 enters the concave strip of the magnet can.
Figure 5:
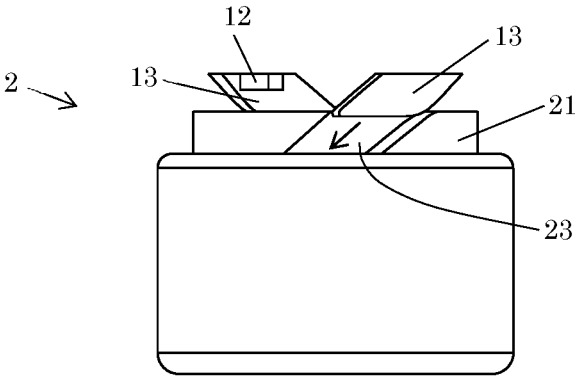
FIG. 5 is a side view showing a state immediately before the convex strip of the impeller of the connection configuration of FIGS. 1 and 2 enters the concave strip of the magnet can.

Reference sign 3 shown in FIGS. 1 and 2 is a rotational bearing, and the impeller 1, the magnet can 2, and the rotational bearing 3 are main constituents of the rotary body for the magnetic pump of the present invention.

The "spigot ferrule" in the present invention is a coupling joint configured to have the same structure as a covering lid of a case, and is a typical coupling joint configured to be used in a piece of wood or a fishing rod, and, in the spigot ferrule, the inserting side is referred to as a "spigot," whereas the inserted side is referred to as a "socket."

In each of the impeller 1, the magnet can 2, and the rotational bearing 3, a basic configuration, such as the blade shape of the impeller 1 or the number of blades of the impeller 1, of other parts except the connection configuration is not limited to that of the embodiment shown in the drawings, and it is possible to employ a publicly-known/publicly-used configuration (which includes materials) as the impeller 1, the magnet can 2, and the rotational bearing 3 that are used in this type of magnetic pump. Additionally, likewise, it is possible to employ a publicly-known/publicly-used configuration as other constituents of the magnetic pump except the impeller 1, the magnet can 2, and the rotational bearing 3.

The restraining member 31 has only a function that prevents the looseness of a fitted connection part between the impeller 1 and the magnet can 2 by being fitted into the gap K after the impeller 1 and the magnet can 2 are attached and fixed together and hence restraining the return of turning of the spigot-ferrule part, and it is preferable to be configured to be formed integrally with the rotational bearing 3 at a front end part of the rotational bearing 3 as shown in the present embodiment.

According to this configuration, the impeller 1 and the magnet can 2 are attached and fixed together, and then the rotational bearing 3 is inserted from the other end side in the rotational-shaft direction of the magnet can 2, and, as a result, it becomes possible not only to complete a bearing configuration but also to simultaneously finish fixing the connection between the impeller 1 and the magnet can 2. In other words, the rotational bearing 3, which is one of the essential constituents of the magnetic pump, is configured to be provided with the restraining member 31, and therefore it is unnecessary to add extra constituents, such as a fixing pin, in order to connect the impeller 1 and the magnet can 2 together, and it is possible to fix the fitting/connection between the impeller 1 and the magnet can 2 by means of a simple mechanism that uses only essential constituents.

Additionally, when maintenance is performed or when repairs are performed, it is possible to extremely easily release the connection/fixation between the impeller 1 and the magnet can 2 by detaching the rotational bearing 3 from a rotational member including the impeller 1, the magnet can 2, and the rotational bearing 3, and therefore it is possible to perform a disassembling operation by pulling the impeller 1 and the magnet can 2 apart from each other while twisting these constituents in a direction opposite to a direction taken when those are fitted and connected together. When the disassembling operation is performed, small additional members, such as a fixing pin, are not used to fix fitting/connection, and therefore the problem of the fixing pin being fastened to a penetration part, which is easily caused when the fixing pin is used, or similar problems never arise, and it is needless to use a dedicated extracting jig, and it is possible to disassemble the rotational member easily and smoothly.

Additionally, in the present embodiment, as a configuration in which the impeller 1 and the magnet can 2 are turned while being fitted and twisted with respect to the rotational shaft when the impeller 1 and the magnet can 2 are fitted together in the rotational-shaft direction, either one (in the present embodiment, an inner wall portion of the socket 11) of an inner wall portion of the socket 11 of the spigot-ferrule part and an outer wall portion of the spigot 21 is provided with a convex strip 13 that is extended obliquely with respect to the rotational-shaft direction, whereas the other one (in the present embodiment, an outer wall portion of the spigot 21) is provided with a concave strip 23 that is entered by the convex strip 13 and that is extended obliquely with respect to the rotational-shaft direction in the same way as the convex strip 13, and, when the socket 11 and the spigot 21 are connected together in a spigot-ferrule manner, the convex strip 13 and the concave strip 23 are configured to act as a guide by which the fitting in the rotational-shaft direction and the twisted turning are guided by allowing the convex strip 13 to enter the concave strip 23 when the impeller 1 is attached to the magnet can 2.

According to this configuration, when the impeller 1 and the magnet can 2 are connected together, it is possible to simultaneously perform the fitting in the rotational-shaft direction and the turning with respect to the rotational shaft by fitting the impeller 1 and the magnet can 2 together while twisting the impeller 1 and the magnet can 2 in the rotational-shaft direction.

In FIG. 3 to FIG. 11, in order to clearly show both a configuration in which the convex portion 12 enters the cutout portion 22 and a configuration in which the convex strip 13 enters the concave strip 23, only the convex portion 12 and the convex strip 13 are depicted concerning the impeller 1, and the depiction of other portions is omitted in the drawings.

Preferably, the convex strip 13 and the concave strip 23 mentioned above are configured so that the twisting/turning direction taken when the convex strip 13 and the concave strip 23 are fitted and connected together becomes opposite to the rotation direction of both the impeller 1 and the magnet can 2 as shown in the present embodiment. According to this configuration, a tightening force acts in directions in which the convex strip 13 and the concave strip 23 are pulled by each other when the impeller 1 makes positive rotation, and therefore the convex strip 13 and the concave strip 23 that come into contact with each other obliquely in the rotation direction are connected together more firmly.

Figure 8:
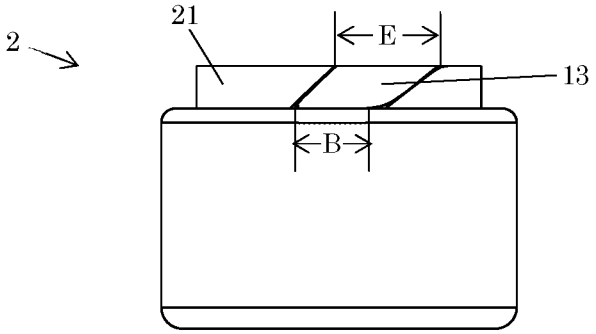
FIG. 8 is a side view showing a state after the convex strip of the impeller of the connection configuration of FIGS. 1 and 2 has entered the concave strip of the magnet can.

Still additionally, it is preferable to set the width in the rotation direction of both the convex strip 13 and the concave strip 23 mentioned above so that the width E on the entrance side of the entering part becomes wide and so that the width B on the innermost side thereof becomes narrow as shown in the front view of FIG. 8 in the present embodiment. According to this configuration, when the convex strip 13 is allowed to enter the concave strip 23 that functions as a guide when the convex strip 13 and the concave strip 23 are fitted and connected together, a narrow front end part of the convex strip 13 first enters a wide entrance of the concave strip 23, and the width of the concave strip 23 and the width of the convex strip 13 gradually approximate each other in proportion to an advance of the convex strip 13, and the convex strip 13 closely enters the concave strip 23 when the convex strip 13 finally enters the innermost of the concave strip 23, and therefore the convex strip 13 and the concave strip 23 are fitted and connected together so that the convex strip 13 is easily tightened with the concave strip 23.

Although the rotary body for the magnetic pump of the present invention has been described on the basis of the embodiment as above, other configurations can be employed within the scope of the present invention.

Although the convex portion 12 and the cutout portion 22 are configured to be provided at two places and two places, respectively, in the aforementioned embodiment, the convex portion 12 and the cutout portion 22 may be provided at one place and one place, respectively, or at three or more places and three or more places, respectively. Preferably, the convex portion 12 and the cutout portion 22 are configured to be provided at about two to four places and two to four places, respectively, at equal intervals therebetween in the rotation direction centering on the rotational shaft. According to the configuration in which they are provided at equal intervals, a load that is applied onto the convex portion 12, the cutout portion 22, etc., is evenly dispersed without being biased when rotated (positively or negatively), and therefore it is possible to prevent damage or breakage.

Additionally, although the convex strip 13 and the concave strip 23 are configured to be provided at two places and two places, respectively, in the aforementioned embodiment, the convex strip 13 and the concave strip 23 may be provided at one place and one place, respectively, or at three or more places and three or more places, respectively. Preferably, the convex strip 13 and the concave strip 23 are configured to be provided at about two to four places and two to four places, respectively, at equal intervals therebetween in the rotation direction centering on the rotational shaft. According to the configuration in which they are provided at equal intervals, a load that is applied onto the convex strip 13, the concave strip 23, etc., is evenly dispersed without being biased when rotated (positively or negatively), and therefore it is possible to prevent damage or breakage.

Additionally, although the restraining member 31 is configured to be formed integrally with the rotational bearing 3 at the front end part of the rotational bearing 3 in the aforementioned embodiment, the restraining member 31 may be a single individual constituent that is structurally independent of the rotational bearing 3.

DESCRIPTION OF REFERENCE NUMBERS

1 Impeller
11 Socket
12 Convex portion
13 Convex strip
2 Magnet can
21 Spigot
22 Cutout portion
23 Concave strip
3 Rotational bearing
31 Restraining member
K Gap
E Width on entrance side
B Width on innermost side

The invention claimed is:

1. A magnetic pump that is a magnet-coupling type pump that generates a liquid transportation force by rotating an impeller disposed at a driven-side magnet by rotating a driving-side magnet, the magnetic pump configured so that the driven-side magnet is housed in a magnet can, and the magnet can is attached to a shaft fixed in a pump casing through a rotational bearing, and the impeller is attached and fixed to an end side in a rotational-shaft direction of the magnet can, wherein the impeller and the magnet can are attached and fixed together such that a socket formed at either one of a part of the impeller and a part of the magnet can that face each other and a spigot formed at a remaining one of the part of the impeller and the part of the magnet can are fitted together in the rotational-shaft direction in a spigot-ferrule manner, and are twisted and turned with respect to the rotational shaft, and are then inhibited from reaching a loosened state while restraining return of a turned state, and, as a result, a connection between the impeller and the magnet can is fixed, and wherein the return of the turned state is restrained such that a cutout portion is formed at either one of an innermost part of the socket and a front end part of the spigot that face each other, and a convex portion is formed at a remaining one of the innermost part of the socket and the front end part of the spigot, and the convex portion is allowed to enter the cutout portion and is turned, and then a restraining member with which a gap generated behind the convex portion in a turning direction of the convex portion is filled is fitted into the gap between the cutout portion and the convex portion, wherein a convex strip that is extended obliquely with respect to the rotational-shaft direction is disposed at either one of an inner wall portion of the socket and an outer wall portion of the spigot that are each a spigot-ferrule part, and a concave strip that is entered by the convex strip is disposed at a remaining one of the inner wall portion and the outer wall portion so as to be extended obliquely with respect to the rotational-shaft direction in the same way as the convex strip, and, when the impeller is attached to the magnet can, fitting and twisting/turning in the rotational-shaft direction are guided by allowing the convex strip to enter the concave strip when the socket and the spigot are connected together in the spigot-ferrule manner, wherein a width in a rotation direction of both the convex strip and the concave strip disposed at the spigot-ferrule part is wide on an entrance side from which the convex strip enters the concave strip, and the width is narrow on an innermost side.

2. The magnetic pump according to claim 1, wherein the restraining member is disposed at a front end part of the rotational bearing that is inserted from an opposite end side in the rotational-shaft direction of the magnet can after the impeller and the magnet can are attached and fixed together.

3. The magnetic pump according to claim 1, wherein the convex strip and the concave strip are formed so that a direction of twisting/turning caused by both the convex strip and the concave strip disposed at the spigot-ferrule part becomes opposite to a rotation direction of both the magnet can and the impeller.

4. A rotary body for a magnetic pump, the rotary body being used for a magnet-coupling type pump that generates a liquid transportation force by rotating an impeller disposed at a driven-side magnet by rotating a driving-side magnet, the rotary body configured to include a magnet can that houses the driven-side magnet and the impeller that is attached and fixed to an end side in a rotational-shaft direction of the magnet can, wherein the impeller and the magnet can are attached and fixed together such that a socket formed at either one of a part of the impeller and a part of the magnet can that face each other and a spigot formed at a remaining one of the part of the impeller and the part of the magnet can are fitted together in the rotational-shaft direction in a spigot-ferrule manner, and are twisted and turned with respect to the rotational shaft, and are then inhibited from reaching a loosened state while restraining return of a turned state, and, as a result, a connection between the impeller and the magnet can is fixed, and wherein the return of the turned state is restrained such that a cutout portion is formed at either one of an innermost part of the socket and a front end part of the spigot that face each other, and a convex portion is formed at a remaining one of the innermost part of the socket and the front end part of the spigot, and the convex portion is allowed to enter the cutout portion and is turned, and then a restraining member with which a gap generated behind the convex portion in a turning direction of the convex portion is filled is fitted into the gap between the cutout portion and the convex portion, wherein a convex strip that is extended obliquely with respect to the rotational-shaft direction is disposed at either one of an inner wall portion of the socket and an outer wall portion of the spigot that are each a spigot-ferrule part, and a concave strip that is entered by the convex strip is disposed at a remaining one of the inner wall portion and the outer wall portion so as to be extended obliquely with respect to the rotational-shaft direction in the same way as the convex strip, and, when the impeller is attached to the magnet can, fitting and twisting/turning in the rotational-shaft direction are guided by allowing the convex strip to enter the concave strip when the socket and the spigot are connected together in the spigot-ferrule manner, wherein a width in a rotation direction of both the convex strip and the concave strip disposed at the spigot-ferrule part is wide on an entrance side from which the convex strip enters the concave strip, and the width is narrow on an innermost side.

5. The rotary body for a magnetic pump according to claim 4, wherein the rotary body includes, in addition to the impeller and the magnet can, a rotational bearing that is inserted from an opposite end side in the rotational-shaft direction of the magnet can after the impeller and the magnet can are attached and fixed together and that serves as the bearing of a shaft fixed in a pump casing, and the restraining member is disposed at a front end part of the rotational bearing that is inserted in the magnet can.

6. The rotary body for a magnetic pump according to claim 4, wherein the convex strip and the concave strip are formed so that a direction of twisting/turning caused by both the convex strip and the concave strip disposed at the spigot-ferrule part becomes opposite to a rotation direction of both the magnet can and the impeller.

* * * * *